US005839314A

United States Patent [19]

Quitmann

[11] Patent Number: 5,839,314

[45] Date of Patent: Nov. 24, 1998

[54] ROLL HOUSING WITH A CLOSED FRAME CONSTRUCTION

[75] Inventor: Uwe Quitmann, Willich, Germany

[73] Assignee: Mannesmann Aktiengesellschaft, Düsseldorf, Germany

[21] Appl. No.: 894,867

[22] PCT Filed: May 18, 1995

[86] PCT No.: PCT/DE95/00676

§ 371 Date: Aug. 15, 1997

§ 102(e) Date: Aug. 15, 1997

[87] PCT Pub. No.: WO96/25250

PCT Pub. Date: Aug. 22, 1996

[30] Foreign Application Priority Data

Feb. 16, 1995 [DE] Germany ..... 195 06 873.4

[51] Int. Cl.[6] ..... B21B 39/20; B21B 31/00

[52] U.S. Cl. ..... 72/252.5; 72/237

[58] Field of Search ..... 72/237, 252.5, 72/226, 199

[56] References Cited

U.S. PATENT DOCUMENTS 1,973,425 9/1934 Biggert ..... 72/483

FOREIGN PATENT DOCUMENTS 56-151108 11/1981 Japan .

*Primary Examiner*—Joseph J. Hail, III

*Assistant Examiner*—Rodney Butler

*Attorney, Agent, or Firm*—Cohen, Pontani, Lieberman & Pavane

[57] ABSTRACT

The present invention relates to a roll housing with a closed frame construction, particularly for heavy roll stands for rolling sheet metal and strip. The roll housing includes two vertical members which delimit the housing window for accommodating and guiding chucks which support the roll. The vertical members have inner surfaces parallel to one another. Upper and lower traverse bars connect the vertical members. The outer sides of each vertical member, which are remote from the housing window, recede toward the housing window between the upper and lower traverse bars such that the shortest distance between the inner surface and outer surface of each of the two vertical members is at a middle position between the upper and lower traverse bars.

5 Claims, 3 Drawing Sheets

ROLL HOUSING WITH A CLOSED FRAME CONSTRUCTION

FIELD OF INVENTION

The present invention relates to a roll housing with a closed frame construction, especially for heavy roll stands for rolling sheet metal and strip. The roll housing comprises two housing uprights, which delimit the housing window for accommodating and guiding the roll chucks (and roll bearings). The two housing uprights also have inner surfaces that are parallel to each other. Upper and lower traverses connect the uprights.

BACKGROUND OF THE INVENTION

Conventional rolling mills consist basically of two roll housings, in which the rolls, which run in bearings that are supported by chucks, are arranged. The two housings are connected to each other at the top and the bottom by transverse connecting parts. The transverse connecting parts and the housings constitute the roll stand. The housings, as constructive bearing parts of the roll stand, absorb all of the forces arising during the rolling process. The housings must therefore have high strength with low deformation and, at the same time, must permit an advantageous arrangement of all of the elements of the stand. For heavy rolling mills, one-piece housings with a closed frame construction are preferred.

As stated above, the housing windows that remain between the housing uprights accommodate the chucks for the bearings of the rolls. The housing windows must therefore be equipped with guides, on which the chucks can move in a sliding fashion. For this reason, exact parallelism is required between the inner surfaces (which are located across from each other) of the housing windows. Also required are narrow distance tolerances, so that the kinetic play between the chucks and the housing uprights is minimized, ensuring only slight size deviations in the rolled material.

In designing roll housings, especially the closed housings described above, it is important to consider the fact that, during the rolling process, the resultant force is oriented roughly vertical to the roll force. This means that the total system is subjected to two equal forces, which act in opposite directions and seek to press the traverses apart from each other. In calculatory terms, a closed housing can be seen as an elastic frame, in which a tensile force (half as great, for example, as the roll force) acts in the vertical direction in the cross-section of the housing uprights, while at the same time a bending moment acts on the corners of the housing (FIG. 2). The traverses, which are connected fixedly to the housing uprights, are stressed exclusively by bending. It is assumed that the greatest stress in the housing exists on the housing uprights in the window areas, because—along with the tensile stresses—these uprights are bent in the direction of the windows by the effective bending moment. The housing window is "necked," i.e., the empty space between the inner sides of the uprights becomes smaller as the result of the roll load.

Since the required rigidity of the roll stand must be guaranteed, every designer attempts to ensure that "necking," as the bending of the housing uprights in the direction of the window is called, is kept to a minimum.

It is easily understood that excessive necking in a roll stand causes the chucks to jam and interferes with their controllability. It is impossible to enlarge the clearance between the chucks and the inner surfaces of the windows, because doing so would impair the stability of the chuck guidance, and size deviations would occur in the rolled material as a result. For these reasons, necking in rolls stands often makes it necessary to retrofit the windows, which entails large expenditures of time and money.

Various proposed solutions to minimize necking in roll stands have, in practice, been only conditionally effective. For example, an attempt has been made, by enlarging the traverses, to reduce the moment that bends the housing uprights. Moreover, the housing uprights themselves have been enlarged, so as to counteract their bending with greater resistance moment. In both cases, the roll stands became heavier and required more material, so that the stands also became very expensive. An attempt has also been made to reduce the rigidity of the housing frame by means of undercuts in the corner areas of the housing windows and thus to simulate a roll stand with practically "articulated joints" between the traverses and the uprights. However, such undercuts significantly weakened the stability of the roll stand in these areas, without bringing the desired success.

SUMMARY OF THE INVENTION

Starting from the described problems, the object of the present invention is to design a closed-frame roll housing in such a way that the necking of the housing window between the housing uprights that results from the roll forces is reduced to an acceptable level, while at the same time stress concentrations in the housing are avoided.

To attain this object, the invention proposes that, for the purpose of reducing the cross-sectional areas of the uprights, the outer sides of each upright (which face away from the housing window) recede, starting at the traverses, in the direction of the housing window. The smallest cross-sectional area of the upright will thus be located in the middle area between the upper and lower traverses.

Tests have shown that the constructive recession in the outer sides of the housing uprights can significantly reduce the necking of the housing uprights in the direction of the window. Contrary to previous assumptions, which held that the stability of the roll stand could be increased—and thus the necking of the housing window reduced—by means of an enlarged housing cross-section, it has been found that when the cross-section of each upright is reduced as described on the outer side of the upright, i.e., the side that faces away from the window, this reduction in cross-section leads to the desired object.

Preferably, the outer side of each upright is provided with a concave contour in its longitudinal direction, so that the cross-sectional area of each upright decreases continuously from the upper and lower traverses to the middle area of the upright.

According to a special feature of the invention, the cross-sectional reduction is describable by a circular-arc-shaped contour running longitudinally on the outer side of each housing upright. The radius midpoint of the circular arc that describes the contour is located in the middle area outside of the upright.

It is also possible for the outer side of each housing upright to have longitudinal contours in the shape of a parabola or, for example, corresponding to the deflection curve of a carrier on two supports.

It is also conceivable, in the framework of the invention, for the outer sides of each upright to be embodied as longitudinal contours describable by progressions; in the extreme case, the polygon could be formed by three points.

The special shape of the housing uprights according to the invention results in substantial advantages compared to the known roll stands. Necking in the central area of the housings can be reduced to roughly zero, so that expensive retrofitting is no longer necessary. This saves time and money, as does the higher availability of the roll stand. The chucks can be guided in the housing window within very narrow tolerances, and the improved chuck guidance as well as the calmer bearing run result in substantially reduced size deviations in the rolled material. The axial load of the roll bearings declines due to reduced twisting of the rolls. The invented measures are extremely simple and are associated with material savings in the housings themselves.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference numerals denote similar elements throughout the several views.

DETAILED DESCRIPTION OF THE PREFERRED EMBODIMENTS

Figure 1:
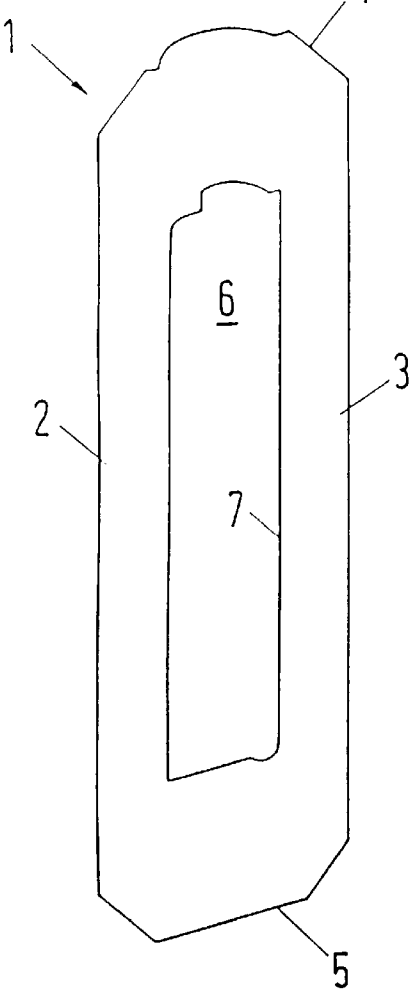
Fig. 1 Prior Art
FIG. 1 is a simplified three-dimensional depiction of a closed-frame roll housing according to the prior art.

FIG. 1 shows a closed-frame roll housing of the type described as the prior art in the introductory part of the description. The roll housing as a whole is identified by reference number 1. The roll housing 1 comprises two housing uprights 2 and 3, which are connected to each other by an upper transverse 4 and a lower traverse 5. A housing window 6 is located in the interior of the closed frame created by this housing design. Inner surfaces 7 of the housing window 6 are located on the housing uprights 2 and 3. These inner surfaces 7 are flat and lie on parallel planes with respect to the opposite housing upright 2 or 3. The upper traverse 4 of the roll stand 1 has a boring for a pressure nut, which is not significant in connection with the present invention. As the drawing shows, the cross-sections of the housing uprights 2 and 3 are the same size between the upper traverse and the lower traverse. Housing window 6 of roll housing 1 receives chucks which support the bearings of rolls in a rolling mill (neither the chucks, the bearings, nor the rolling mill are shown in the figures).

Figure 2:
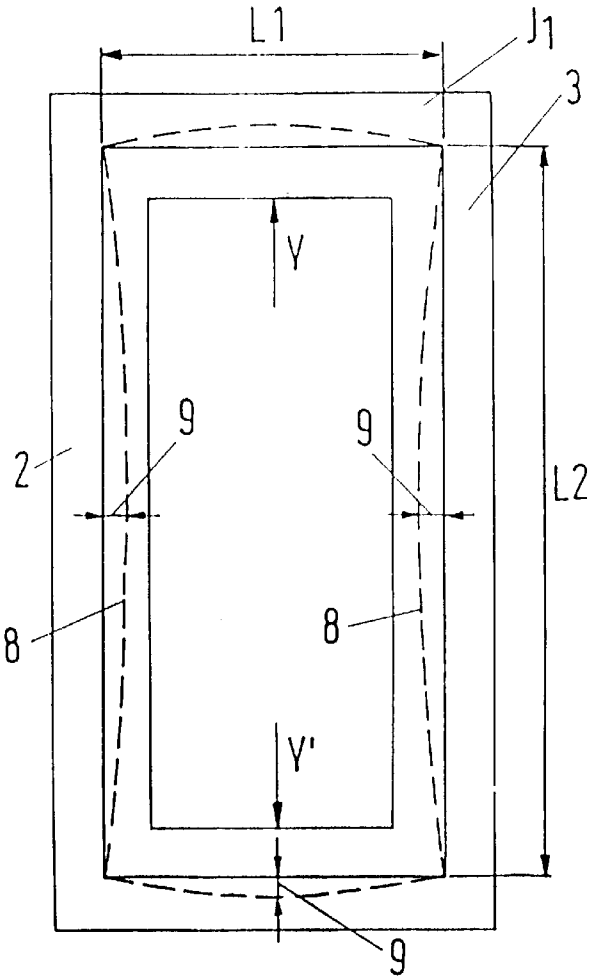
Fig. 2 Prior Art
FIG. 2 shows the necking and bending of a housing window of a prior art roll housing expected under a roll load.

FIG. 2 shows, in schematic fashion, the deformation of the roll housing 1 that occurs when the vertical roll forces Y and Y' bend apart the upper and lower traverses 4, 5 of the roll housing 1. The housing uprights 2 and 3 bend inward, as the dashed line 8 shows, reducing the empty space of the housing window 6. The extent of this reduction in size of the housing window 6 depends on the size of the effective forces Y and Y' on the dimensions L1 and L2 of housing traverses 4 and 5 and housing uprights 2 and 3, and on their resistance moments $J_1$.

Figure 3:
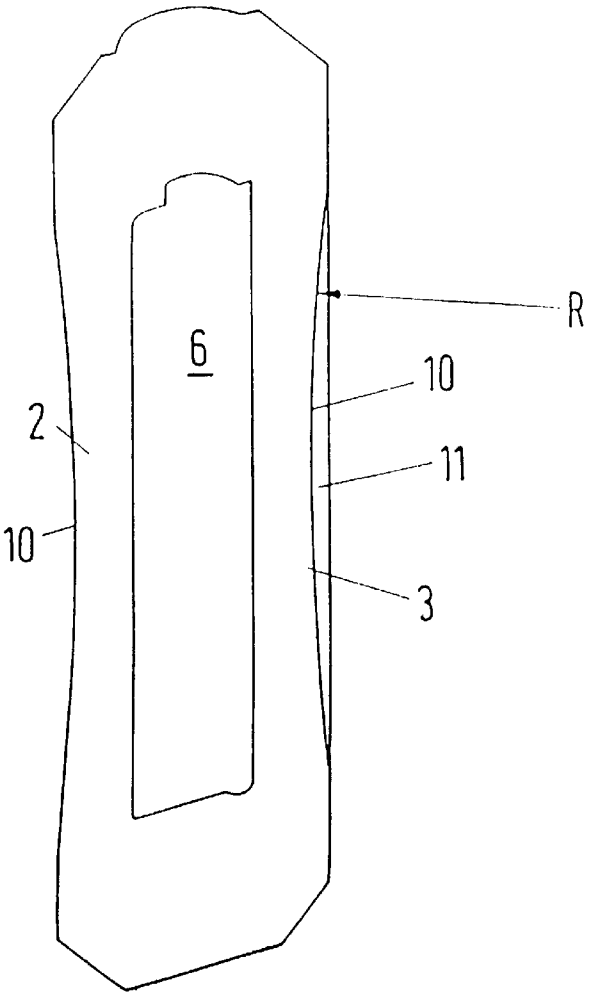
FIG. 3 shows a roll housing according to the present invention.

It has been shown that the extent 9 of the bending or necking of the housing uprights 2, 3 can be significantly reduced and will approach zero when, according to the proposal of the invention, the housing elements 2 and 3 are narrowed in the direction of the housing window 6, as shown in FIG. 3. For example, the outer sides 10 of the housing uprights 2 and 3 are provided with a contour described by a circular arc with radius R, the midpoint of the circle with radius R being located on an imaginary horizontal line that passes through a center 11 of the roll housing 1 outside of the housing. In the example, the radius R is selected in such a way that the extent of recession in the two housing uprights 2 and 3 is approximately 30% of the non-necked upright in FIG. 1. For purposes of calculation, the example assumes a roll housing with a total height of 14,900 mm and an upright with a thickness of 960 mm. The assumed height of the lower and upper traverses is 2300 mm. A variant 1 of the present invention includes a constructive recession on the outer side 10 of each of the two housing uprights 2 and 3 of 250 mm. A variant 2 of the present invention includes a constructive recession of 295 mm on the outer side 10 of each of the two housing uprights 2 and 3.

Figure 4:
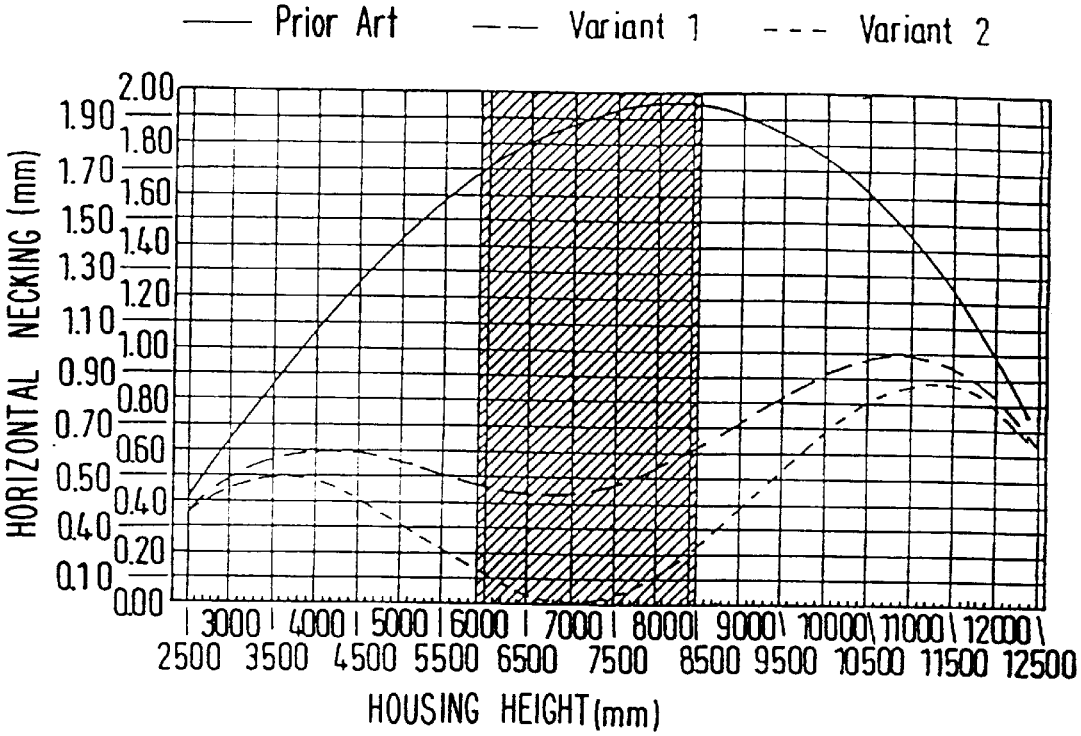
FIG. 4 is a diagram of horizontal necking in roll housings according to the prior art and according to the present invention.

FIG. 4 shows, in diagram form, the extent of horizontal necking relative to housing height. The solid line represents the necking of the prior art roll housing. The line with longer dashes represents Variant 1 (i.e., with a recession of 250 mm). The line with shorter dashes represents Variant 2 (i.e., with a recession of 295 mm). The drawing clearly shows that, in the case of the uprights not embodied according to the present invention, horizontal necking of almost 2 mm can be expected in the middle of the housing. Both Variant 1 and Variant 2 display significantly reduced necking over the entire housing height. In the case of Variant 2 (i.e, with a recession of 295 mm), necking in the middle area of the housing approaches zero even at 100% roll load.

Figure 5:
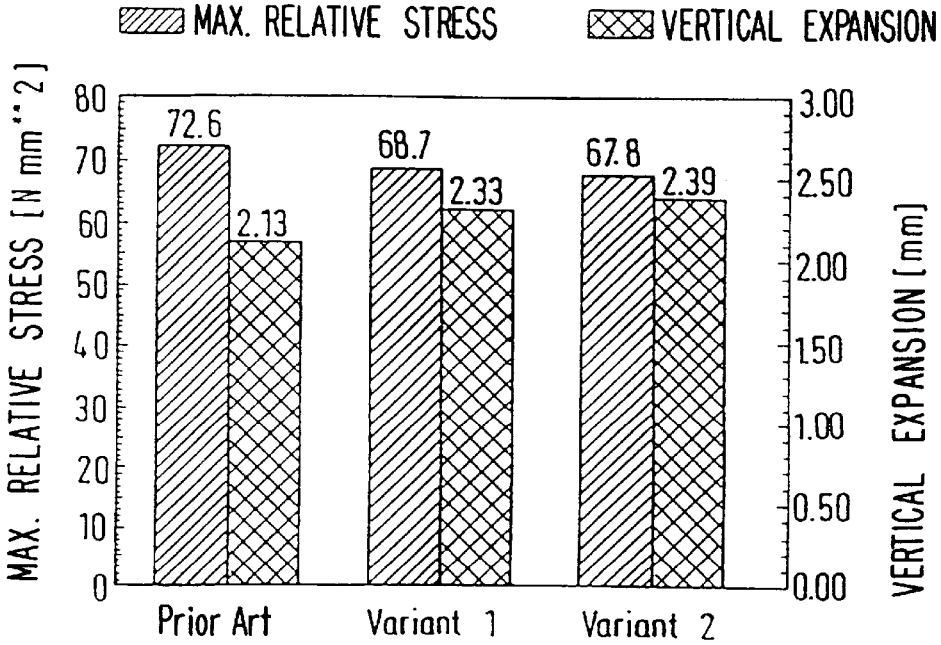
FIG. 5 is a bar chart comparing the maximum relative stresses and vertical expansions of housings according to the prior art and the present invention.

This finding is confirmed by the bar chart in FIG. 5. This diagram clearly indicates that the embodiment of the roll housing according to the invention reduces the relative stress of 72.6 $N/mm^2$ in the prior art to 67.8 $N/mm^2$ in Variant 2. Although there is a slight vertical expansion of the housing, from 2.13 to 2.39 mm, in the direction of the effective forces Y and Y', this vertical expansion of the roll housing, compared to the necking of the housing window, is harmless and negligible.

Figure 6:
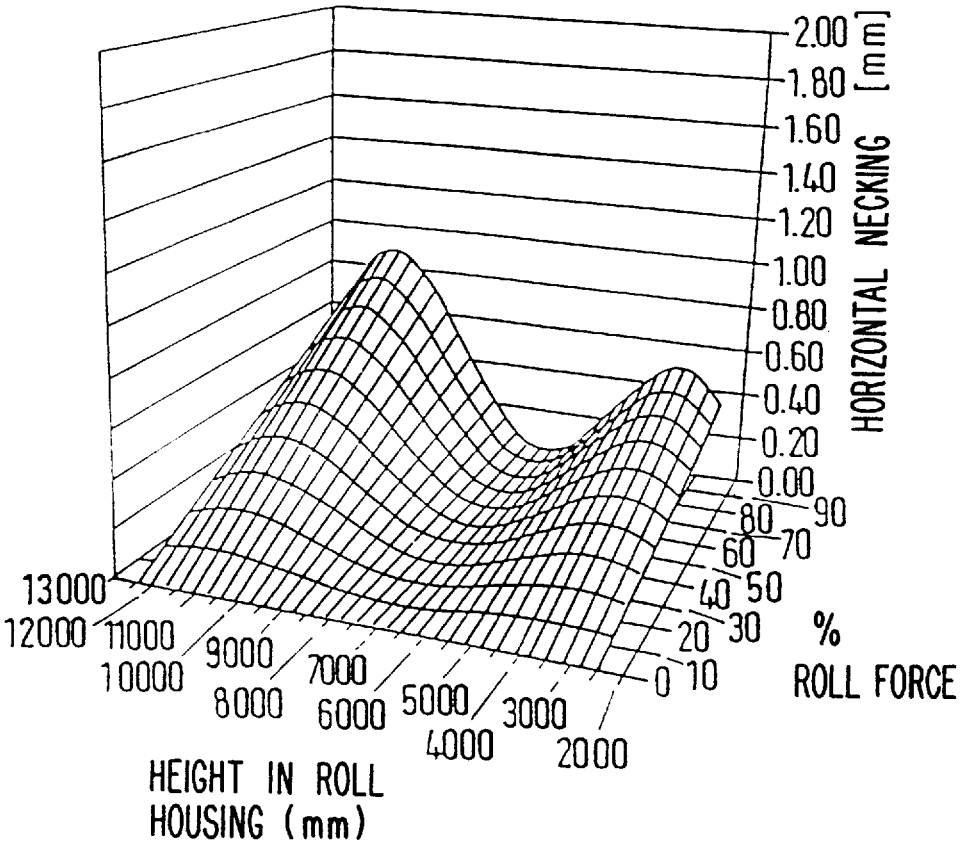
FIG. 6 is a three-dimensional diagram of necking in a roll housing according to the present invention, at roll forces between 0 and 100%, relative to the height of the roll housing.

FIG. 6 shows the horizontal necking in a roll housing according to the invention in a three-dimensional diagram and in dependence on the roll force percentage. Here, too, a significant reduction in necking, which approaches zero, can be seen even at 100% roll force. A roll housing according to the present invention thus attains the stated object in a simple manner.

The invention is not limited by the embodiments described above which are presented as examples only but can be modified in various ways within the scope of protection defined by the appended patent claims.

I claim:

1. A roll housing having a closed frame construction, comprising:

first and second housing uprights, each having an inner surface and an outer surface;

upper and lower traverses connecting upper ends and lower ends of said first and second housing uprights;

a housing window, being delimited on its sides by said inner surface of each of said first and second housing uprights, for receiving chucks for supporting bearings of rolls;

said inner surface of one of said first and second housing uprights being parallel to said inner surface of the other of said first and second housing uprights; and said outer surface of each of said first and second housing uprights, which faces away from said housing window, receding toward said housing window between said upper and lower traverses such that a shortest distance between said inner surface and said outer surface, of each of said first and second housing uprights is at a position between said upper traverse and said lower traverses, said receding of said outer faces toward said housing window substantially reduce necking of said first and second uprights in a direction toward said housing window.

2. The roll housing with a closed frame construction of claim 1, wherein said outer surface of each of said first and second housing uprights has a concave contour running in a longitudinal direction of said uprights.

3. The roll housing with a closed frame construction of claim 1, wherein said outer surface of each of said first and second housing uprights has a circular-arc-shaped contour running in a longitudinal direction of said uprights.

4. The roll housing with a closed frame construction of claim 1, wherein said outer surface of each of said first and second housing uprights has a parabolic contour running in a longitudinal direction of said uprights.

5. The roll housing with a closed frame construction of claim 1, wherein said outer surface of each of said first and second housing uprights has a contour describable by progressions in a longitudinal direction of said uprights.

* * * * *